United States Patent [19]

Lin

[11] 3,968,593

[45] July 13, 1976

[54] VARIABLE-INERTIA FLYWHEEL

[76] Inventor: Shi-Tron Lin, 54, Yen-Ping N. Rd., Sec. 2, Taipei, Taiwan, China

[22] Filed: Aug. 22, 1974

[21] Appl. No.: 499,628

[52] U.S. Cl. ..... 46/209; 46/207

[51] Int. Cl.[2] ..... A63H 29/20

[58] Field of Search ..... 46/201, 202, 206, 207, 46/209, 211, 213, 243 LV, 47, 64, 65; 74/572; 185/27

[56] References Cited

UNITED STATES PATENTS

| | | | |
|---|---|---|---|
| 2,575,743 | 11/1951 | Biggs | 46/207 |
| 2,668,391 | 2/1954 | Huard et al. | 46/211 X |
| 2,677,216 | 5/1954 | Hein | 46/209 |
| 3,060,634 | 10/1962 | Fisher | 46/207 |
| 3,798,835 | 3/1974 | McKeehan | 46/211 X |
| 3,826,039 | 7/1974 | Disko et al. | 46/209 |
| 3,859,749 | 1/1975 | Morin et al. | 46/39 |

FOREIGN PATENTS OR APPLICATIONS

| | | | |
|---|---|---|---|
| 1,145,460 | 10/1957 | France | 46/1 G |
| 1,003,107 | 2/1957 | Germany | 46/211 |
| 653,760 | 11/1937 | Germany | 46/211 |

*Primary Examiner*—Jack Q. Lever

[57] ABSTRACT

A vehicle carries a variable inertia flywheel which is mechanically connected to the road wheels of the vehicle. Change of inertia of the flywheel influences the motion of the vehicle in acceleration, deceleration, swerving.

9 Claims, 4 Drawing Figures

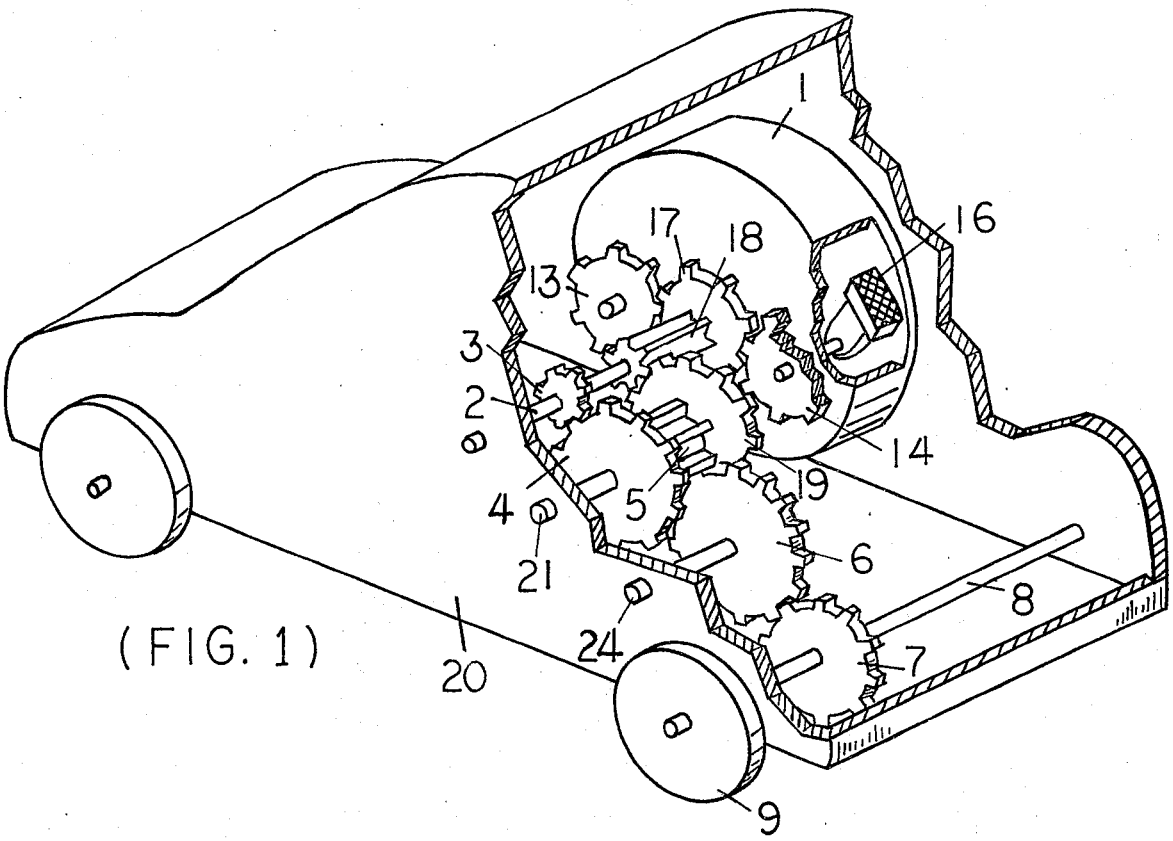
(FIG. 1)
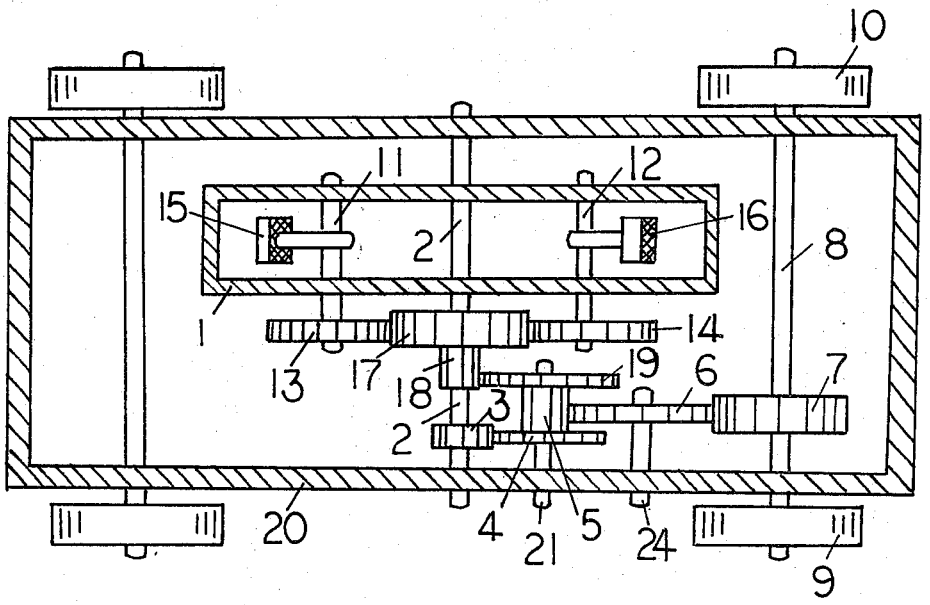
(FIG. 2)

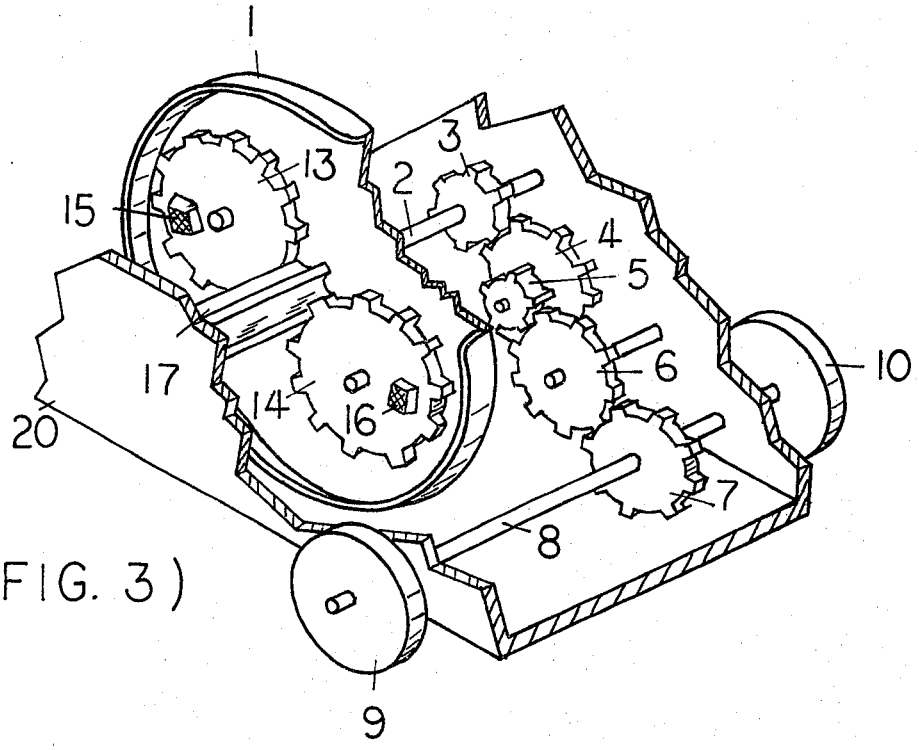
(FIG. 3)
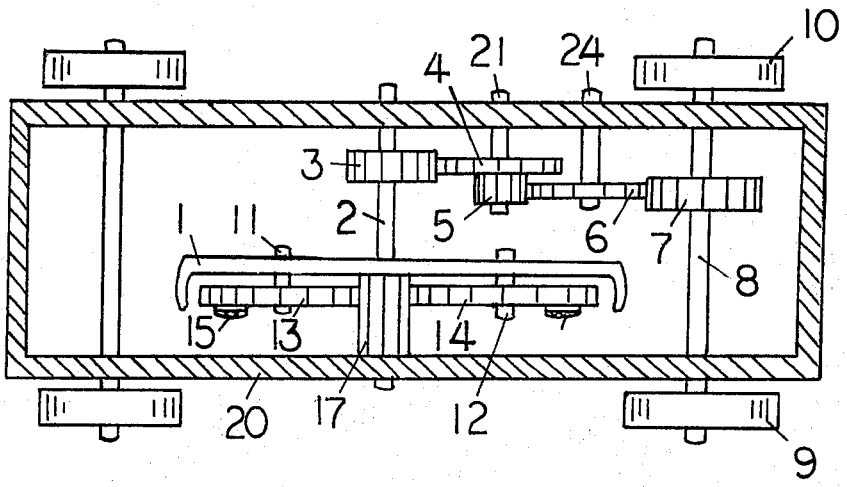
(FIG. 4)

VARIABLE-INERTIA FLYWHEEL

BRIEF INTRODUCTION

The conventional flywheel-propelled toy vehicles can keep almost constant velocity for a long time by storing energy in the flywheel, and thereby transmitting energy to the road wheels through a set of gears.

The objective of the invention is to provide a mechanical structure so that the inertia of the flywheel is changed during motion through arrangements such as gears, belts, levers, etc.. This new type of flywheel will result in self-variable velocity, either rotational or translational, without external force. It can be applied to many devices as long as this effect is desired, such as to aid the deceleration or acceleration of auto vehicles during stop and go, as well as to save energy. The application to toy vehicle will be described in detail as one of the cases. An interesting effect is: If said toy vehicle is given certain amount of energy by being pushed along the ground and then is released from hand at proper moment, said vehicle will keep on increasing speed by itself for a while. Furthermore, if said flywheel is mounted horizontally on the vehicle, said vehicle will also have a tendency to change direction by itself, therefore said vehicle will swerve leftward and rightward alternatively if front wheels are designed to be flexible in direction. This will produce an effect of surprise, and also intuitively lead the child to the fascinating Physics world.

BRIEF DESCRIPTION OF THE DRAWINGS:

FIG. 1 is a perspective view of a toy vehicle with self-variable inertia flywheel.

FIG. 2 is the top view of the toy vehicle shown in FIG. 1.

FIG. 3 is a perspective view of another type of toy vehicle according to the principle.

FIG. 4 is the top view of the same vehicle shown in FIG. 3.

Referring to FIG. 1, 1 is a cylindrical protective hollow shell rigidly attached to a shaft 2, which is freely carried in vehicle body 20. Rigidly securd to said shaft 2 also is a gear 3, which meshes with the gear 4. Said gear 4 is attached rigidly to gear 5. Both 4 and 5 are pivotally secured to shaft 21, which is fixed to said vehicle body 20. Said gear 5 meshes with another gear 6, which is pivotally secured to shaft 24 and also meshes with gear 7 that is fixed rigidly to shaft 8. Road wheels 9, 10 are rigidly attached to said shaft 8.

So far the structure can be used to describe a traditional flywheel propelled toy vehicle if said hollow shell 1 were a solid heavy one.

11 is a shaft freely carried in said shell 1. A gear 13 and a weight 15 are rigidly secured to said shaft 11. Similar arrangements are shaft 12, weight 16 and gear 14. Those are symmetrical portions of 11, 15 and 13 with respect to said shaft 2. Two gears 17 and 18 are rigidly connected together and pivotally secured to said shaft 2. Said gear 17 meshes with said gears 13 and 14. Said gear 18 meshes with another gear 19 which is attached rigidly to said gears 5 and 4. It is designed that the gear ratio of 19 to 18 is different from that of 4 to 3.

It will be readily understood from the above structure that self-variable-velocity of said toy vehicle can be achieved. All parts are made as light as possible except said weights 15 and 16. From now on we shall consider said shell 1 together with 11, 13, 15 and 12, 14, 16 as a whole, and name it as variable-inertia flywheel, or simply, a flywheel. The inertia of said flywheel is smaller if said weights 15 and 16 are closer to said shaft 2, and vice versa. By contacting said road wheels with certain surface, and constantly moving in one direction, the rotary motion of said road wheels will be transmitted through said gears 7, 6, 5 and then separately, from 4, 3 to said shell 1, and from 19, 18 to said gear 17. Because of the different gear ratios of 19 to 18 and 4 to 3, said shell 1 and said gear 17 will not rotate at the same angular velocity. However, the difference is rather small by suitably designing the gear ratios of 13 to 17, 19 to 18, and 4 to 3. More clearly, if the angular velocity of 1 is $\omega_1$, and that of 17 is $\omega_2$, since $\omega_1$ is not equal to $\omega_2$, said gear 13 is forced to rotate about said shaft 11 by the gearing engagement with 17. The relative angular velocity of 13 with respect to said shell 1 will be $\omega_1-\omega_2$ times the gear ratio of 17 to 13. Since said weight 15 is rigidly attached to said gear 13 through said shaft 11, said weight 15 will shift radially inward and outward as said flywheel rotates. Similar motion happens to another said weight 16 which always remains at symmetrical position of said weight 15 with respect to said shaft 2.

By conservation of kinetic energy, it can be easily proved that said vehicle will move faster when said weights 15, 16 are closer together, and vice versa. However, if $\omega_1=\omega_2$, which can be achieved by adjusting gear ratios, then said weights 15, 16 will keep constant distance to said shaft 2, and said vehicle will move at constant velocity. It is also noticed that the angular momentum of said flywheel is not conserved during motion, and there will be a torque exerts from said flywheel to said vehicle. If said flywheel is mounted horizontally on said toy vehicle, said vehicle will have a tendency to swerve without external force.

Another simplified structure is also described here. Its plan view is shown in FIG. 4. The three dimentional view of major parts is shown in FIG. 3. Compared with FIG. 2, said gears 18, 19 are taken away. The series of gears 3, 4, 5, 6, 7 is arranged on the other side of said shell 1. Said gear 17 is now attached rigidly to said vehicle body 20. Said shaft 2 is still freely carried in said vehicle body 20 as well as in 17. Said weights 15, 16 are now attached directly to said gears 13, 14. This simplified structure will essentially perform the same type of speed-variable motion, only the period of changing speed is difficult to be made very long unless some proper arrangements, such as increasing the gear ratios of 13, 14 to 17 are made.

The principle of the invention is to set a weight as part of the flywheel, and said weight will "shift radially inward or outward" during motion without external force by a set of mechanical arrangements such as gears, belts, levers, cams, and many more. Any person skilled in the art can easily modify some mechanical structures according to my principle. Since it is so easy to change the mechanical arrangements without significant deviation from my principle, I therefore do not wish to be understood as limit myself to the structures specifically described above. The scope of the invention will be defined hereinafter presented.

Having thus described my invention, I claim as new and desire to secure by Letters Patent are:

1. A vehicle comprising a vehicle body including at least one ground engaging wheel rotatably connected to said vehicle body, a main shaft mounted for rotation within said vehicle body, a flywheel rigidly connected to said main shaft, said flywheel including weight means capable of being shifted radially with respect to said main shaft, drive train means between said at least one ground engaging wheel and said main shaft for transmitting inertia to said flywheel in response to the rotative motion of the said at least one ground engaging wheel and means for shifting said weight means radially with respect to said main shaft to cause a variable inertia response in said vehicle through the interaction of said weight means and said flywheel.

2. The vehicle of claim 1 wherein the flywheel is hollow and the weight means comprise at least one weighted shaft rotatably mounted within said flywheel.

3. The vehicle of claim 1 wherein the weight means comprise weighted gears rotatably mounted on said flywheel and located symmetrically with respect to said main shaft.

4. The vehicle of claim 1 wherein the means for shifting the said weight means comprises a gear train connected to said at least one ground engaging wheel.

5. In claim 1 wherein said vehicle is a flywheel propelled toy vehicle.

6. In the vehicle of claim 2, wherein said weighted shaft is at least two, mounted symmetrically with respect to said main shaft.

7. The vehicle of claim 2 wherein the means for rotating the said weight means comprises a gear train connected between the weighted shaft and the at least one ground engaging wheel.

8. The vehicle of claim 3 wherein the means for rotating the said weight means comprise a gear fixly mounted on said vehicle body whereby said weighted gears mesh with the fixed gear when the flywheel and main shaft rotate.

9. The vehicle of claim 7 wherein the gear train includes a weighted shaft gear attached to each weighted shaft, a central gear in engagement with each weighted shaft gear and rotatably supported on said main shaft whereby said main shaft and flywheel can rotate with respect to said central gear and weighted shaft assembly.

* * * * *